US006401803B1

(12) United States Patent
Hahn

(10) Patent No.: US 6,401,803 B1
(45) Date of Patent: Jun. 11, 2002

(54) STAKE FOR TUBE BUNDLE

(75) Inventor: Robert B. Hahn, Virginia Beach, VA (US)

(73) Assignee: The Atlantic Group, Inc., Norfolk, VA (US)

( * ) Notice: Subject to any disclaimer, the term of this patent is extended or adjusted under 35 U.S.C. 154(b) by 0 days.

(21) Appl. No.: 09/734,652

(22) Filed: Dec. 13, 2000

(51) Int. Cl.[7] ..... F28F 7/00; F28D 7/00; F22B 37/24

(52) U.S. Cl. ..... 165/69; 165/162; 122/510

(58) Field of Search ..... 165/69, 162; 122/510

(56) References Cited

U.S. PATENT DOCUMENTS

| | | | | | |
|---|---|---|---|---|---|
| 3,637,008 | A | * | 1/1972 | Michel et al. | 165/69 |
| 4,285,396 | A | | 8/1981 | Schwoerer et al. | |
| 4,337,827 | A | | 7/1982 | Jabsen | |
| 4,384,697 | A | * | 5/1983 | Ruhe | 165/162 |
| 4,595,161 | A | * | 6/1986 | Williams | 165/162 |
| 4,648,442 | A | * | 3/1987 | William | 165/162 |
| 4,702,311 | A | * | 10/1987 | Bizard | 165/162 |
| 4,768,585 | A | | 9/1988 | Hayes et al. | |
| 4,860,697 | A | * | 8/1989 | Malaval | 122/510 |
| 4,917,172 | A | * | 4/1990 | Falduti | 165/69 |
| 4,919,199 | A | | 4/1990 | Hahn | |
| 5,072,786 | A | | 12/1991 | Wachter | |
| 5,213,155 | A | | 5/1993 | Hahn | |
| 5,497,827 | A | | 3/1996 | Cornic | |
| 5,553,665 | A | * | 9/1996 | Gentry | 165/69 |
| 5,713,412 | A | | 2/1998 | Wepfer et al. | |

FOREIGN PATENT DOCUMENTS

| | | | | | |
|---|---|---|---|---|---|
| GB | 2151766 | A | * | 7/1985 | 165/69 |

* cited by examiner

*Primary Examiner*—Henry Bennett
*Assistant Examiner*—Tho V Duong
(74) *Attorney, Agent, or Firm*—Birch, Stewart, Kolasch & Birch

(57) ABSTRACT

A cradle stake (28) for being inserted transversely into a lane (20) between first and second rows (16) of tubes (14) in a tube bundle (10), for damping movement of the tubes in the bundle, includes first and second elongated metal strips (30, 32), which are arranged with their inner sides (40) facing one another, and a plurality of compression springs (42, 44 and 46) extending between the inner sides and being attached to the metal strips. In one embodiment, the springs have progressively greater lengths so that the metal strips are tapered, one to the other. In one embodiment, each elongated metal strip has a V-shaped bend along its length so that the metal strips themselves are also resilient, and each of the elongated metal strips includes indentation saddles (52) on outer sides thereof for engaging the tubes.

17 Claims, 2 Drawing Sheets

STAKE FOR TUBE BUNDLE

BACKGROUND OF THE INVENTION

This invention relates generally to the art of condenser and heat exchanger tube bundles, and more specifically to stakes for being inserted into lanes between rows of tubes within the condenser and heat exchanger tube bundles in order to dampen vibrations of, and provide support for, tubes in the rows.

It is well-known that tube bundles used in heat exchangers and condensers are prone to sympathetic vibrations and movement, as a consequence of high-velocity fluid, such as steam, flowing about the tubes as well as temperature and density changes within and outside of the tubes. Such vibrations are oscillatory in nature, and the oscillations can reach critical amplitudes and severely damage the tubes.

This problem is often encountered when a heat exchanger is refurbished by installing new tubes. For example, if a turbine heat exchanger, in which original tubes were of Admiralty brass or other relatively stiff materials, is refurbished ("re-tubed") to have tubes of lighter weight noble metal materials, such as titanium, there is a good chance that undue vibrations will occur unless some remedial action is taken. Explaining this in more detail, heat-exchanger tube bundles have tube sheets at ends of the tubes and support plates at spaced intervals between the tube sheets. Both the tube sheets and the support plates have multiple holes drilled therein for receiving the tubes and holding them at the spaced intervals along their lengths. The tube sheets arc attached to and sealed with the tubes, but the intermediate support plates have larger holes so that there is some play about the tubes, which play allows the tubes to be inserted through the support plates during fabrication and refurbishing. A proper interval between the support plates is determined by a Design Guide published by the Heat Exchange Institute, which sets forth a maximum interval between support plates for tubes made of particular materials. When tubes of certain materials, such as titanium and stainless-steel for example, are placed in a heat exchanger that was originally designed with support-plate intervals for brass tubes, the interval spacings are often too great for the titanium or stainless-steel tubes, which, in turn, increases the potential for vibrations in the tubes.

Further, older heat exchangers often have changed dynamics as a result of re-tubing, which sometimes effectively changes the sizes of the holes in the support plates. This can also lead to increased vibrations.

An array of heat-exchanger tubes in a bundle normally has lanes between rows of tubes transverse to longitudinal axes of the tubes. These lanes are determined by patterns of holes in the tube sheets and the support plates.

One method which has been effectively used for damping vibrations of refurbished heat exchangers and condensers has been to insert stakes into these lanes approximately midway between the support plates for pressing against tubes on opposite sides of the lanes and thereby damping movements of spans of tubes between the support plates. This, of course, reduces vibrations. An example of such a stake is a Cradle Lock (registered trademark of The Atlantic Group, Inc.) stake which is disclosed in U.S. Pat. 4,919,199 to Robert B. Hahn. Bends of metal-strip stakes described in this patent turn them into leaf springs which provide resiliency to press against adjacent tubes, on opposite sides of the lane, and muffle their movement.

However, a bent metal strip stake of the type described in U.S. Pat. No. 4,919,199 will not work well where the width of a lane is too great or, similarly where its width expands outwardly to become too great. In such cases U-shaped stakes of the type disclosed in U.S. Pat. No. 5,213,155 to Robert B. Hahn have sometimes been used. These U-shaped stakes have two arms which extend along opposite sides of a row of tubes, with the arms being pulled together on the tubes by tie fasteners at points along the arms. Thus, each of the tubes in the row of tubes is dampened by the U-shaped stake's interaction with tubes only in that row; which contrasts with the manner in which the stake of the U.S. Pat. No. 4,919,199 dampens tubes in a first row by interacting with tubes in a second row and vice versa. Such a U-shaped stake, although effective, is extremely time-consuming and expensive to install because it is difficult to apply the tie fasteners and because a U-shaped stake must normally be applied to each row of tubes as each tube is installed.

Stakes have also been structured to include first and second elongated bent metal strips held spaced from one another by rigid pins. Such stakes function substantially as do the individual bent metal strips of the stakes described in U.S. Pat. No. 4,919,199; that is they are inserted in lanes between adjacent rows of tubes with the bent metal strips, which form leaf springs as mentioned above, applying resilient pressure on the tubes of the adjacent rows. The rigid pins separating the bent metal strips increase the sizes of the stakes so that they can be used in wider lanes then can the stakes of U.S. Pat. No. 4,919,199. Also, the rigid pins of a single stake can be made of increasingly different lengths so that the bent metal strips extend on an angle to each other, thereby allowing the stake to be used in a lane having a tapered shape. Although such stakes have advantages in cases where the lanes are large and/or are tapered, and the tubes are evenly spaced, each individual stake is limited in use to lanes having widths within an unduly restricted width range.

It is, therefore, an object of this invention to provide a stake for use in heat exchangers and condensers which can be used in lanes within extremely large and varying width ranges. Similarly, it is an object of this invention to provide a stake having a broader application then do other known stakes, which therefore, in turn, reduces the number of stakes which must be made available for damping tube vibrations of condensers and heat exchangers.

SUMMARY OF THE INVENTION

According to principles of this invention, a stake for being inserted transversely into a lane between first and second rows of tubes in a tube bundle, for damping movement of the tubes in the bundle, includes first and second elongated metal strips, which are arranged with their inner sides facing one another, and a plurality of compression springs extending between the inner sides and being attached to the metal strips. With this structure, when the stake is inserted into a lane between first and second rows in the tube bundle, the first and second metal strips respectively contact tubes of the first and second rows, thereby compressing the springs which, in turn, urges, via the first and second elongated strips, the tubes of the first row away from the tubes of the second row, and vice versa. This, of course, dampens movement of the tubes in the first and second rows, thereby preventing vibrations. In one embodiment, the springs have progressively greater lengths so that the metal strips are tapered, one to the other. In the preferred embodiment the springs are coiled springs.

In one embodiment, each elongated metal strip has a V-shaped bend along its length so that the metal strips themselves are also resilient, and each of the elongated metal strips includes saddles on the outer sides thereof for engaging the tubes.

BRIEF DESCRIPTION OF THE DRAWINGS

The invention is described and explained in more detail below using embodiments shown in the drawings. The described and drawn features can be used individually or in preferred combinations in other embodiments of the invention. The foregoing and other objects, features and advantages of the invention will be apparent from the following more particular description of the preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DETAILED DESCRIPTION OF THE PREFERRED EMBODIMENT

Figure 1:
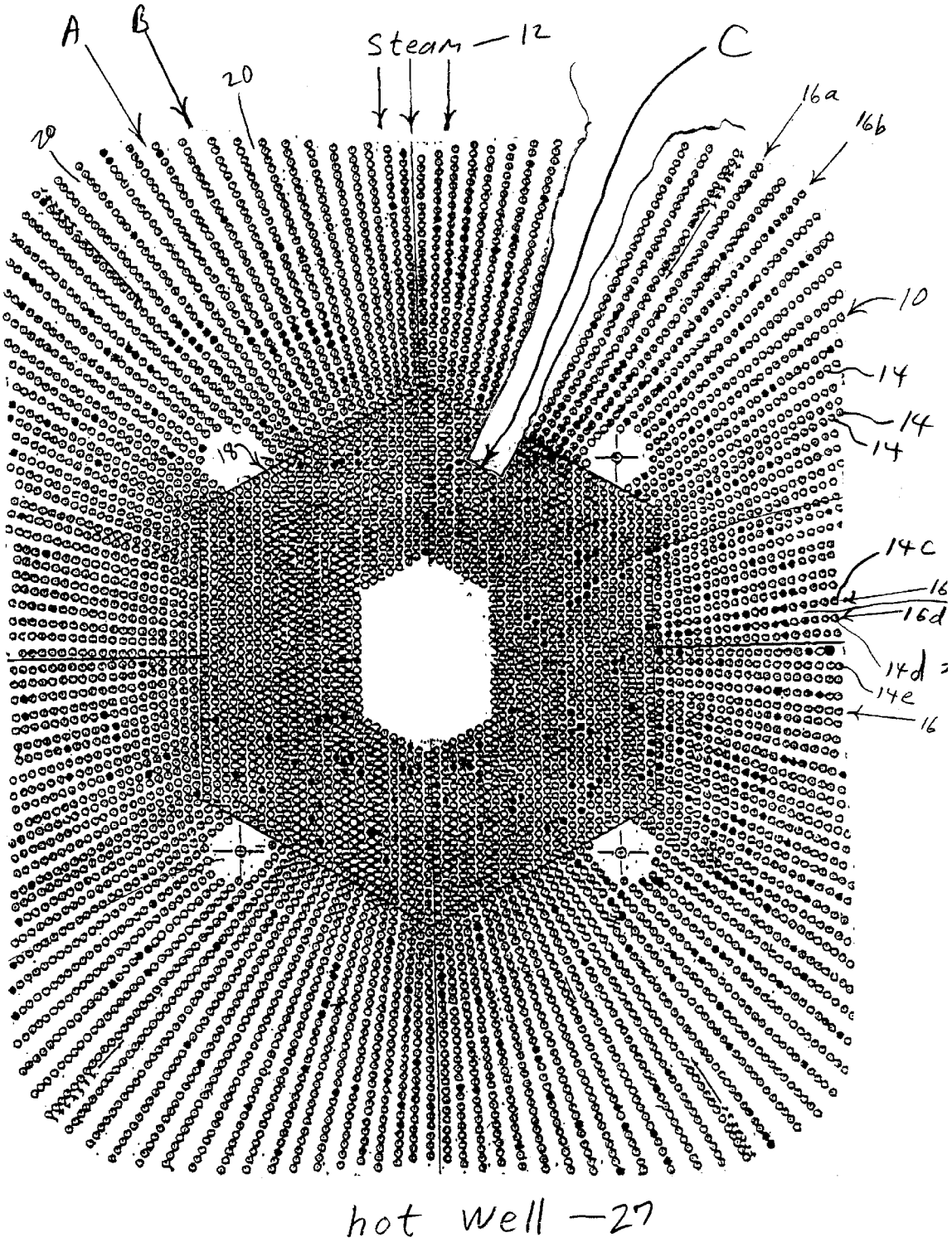
FIG. 1 is a schematic cross-sectional view of a heat-exchanger tube bundle for a heat exchanger of a turbine.

FIG. 1 depicts a heat exchanger tube bundle 10 for condensing steam 12 which has just driven a turbine. Heat exchanger tubes 14 are basically arranged in rows 16, with four radial rows 16*a–d* being particularly marked in FIG. 1. The letter C designates densely arranged interior tubes which are inside an area designated by a hexagon 18 in FIG. 1.

Figure 2:
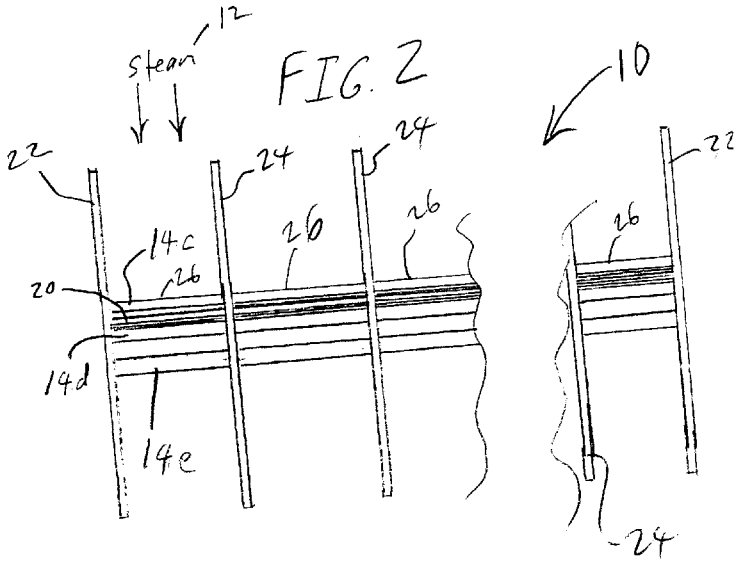
FIG. 2 is a schematic, fragmented, cutaway representation of the heat-exchanger tube bundle of FIG. 1, taken transversely thereto.

FIG. 2 depicts the same tube bundle 10, but seen from a transverse position, 90 degrees to the view of FIG. 1. Only a few of the tubes are depicted in FIG. 2 for purposes of clarity. In this respect, in FIGS. 1 and 2 the tubes 14*c*, 14*d* and 14*e* are depicted, with tubes 14*c* and 14*d* being the outer-most tubes of rows 16*c* and 16*d*. A line 20*a* is formed between the tubes of the rows 16*c* and 16*d*. As can be seen in FIG. 1, the rows 16 of tubes extend radially outwardly, so that adjacent rows tend to diverge from each other, thereby forming tapered, or flared, lanes 20.

The tubes 14 are held in these positions by tube sheets 22, which are positioned at the ends of, and sealed with, the tubes 14, and support plates 24 which arc positioned at regular spaced intervals between the tube sheets 22. Both the tube sheets 22 and the support plates 24 have a pattern of holes bored therein for receiving the heat exchanger tubes 14. Thus, the tube sheets 22 and the support plates 24 hold the heat exchanger tubes 14 in position and should prevent them from unduly vibrating. The steam 12 which has just been used to drive a turbine is blasted into the tube bundle 10, usually from above, and this steam is cooled by a fluid passing through the heat exchanger tubes 14. The cooled steam eventually becomes water, which water is deposited into a hot well 27 at the bottom of the tube bundle 10. In any event, the steam 12 which first hits the heat exchanger tubes 14 is traveling the fastest. As the steam gets further into the tube bundle 10, it loses speed and therefore has less dynamic impact on the tubes 14.

With regard to the dynamic impact the steam has on the heat exchanger tubes 14, the tremendous speed at which the steam impacts the tubes at spans 26 (the spans being those portions of the tubes between the support plates 24), along with heat changes, can cause the tubes at the spans 26 to vibrate if the tubes 14 are not the type of tubes for which the lengths of the spans 26 were designed. For example, as mentioned above, if the tubes sheets 22 and the support plates 24 are spaced from one another at intervals to prevent vibrations in brass tubes, but then the tube bundle is "re-tubed" with titanium tubes, it is more likely that vibrations will occur at the spans 26.

Figure 3:
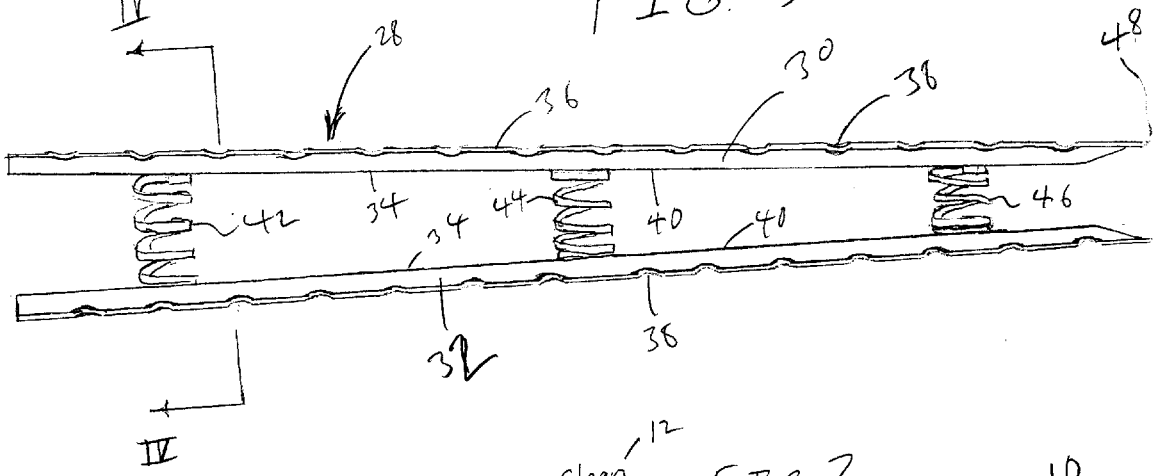
FIG. 3 is a side elevational view of a stake of this invention.
Figure 4:
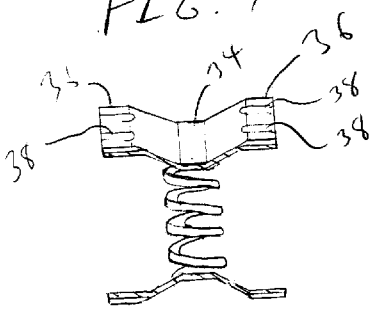
FIG. 4 is a cross sectional view taken on line IV—IV in FIG. 3.

A stake 28, depicted in FIGS. 3 and 4, is intended to prevent vibrations of the heat exchanger tubes 14 at their spans 26. The stake 28 includes first and second bent metallic strips 30 and 32. Each of the first and second bent metallic strips 30 and 32 is quite similar to the bent metallic strips described in U.S. Pat. No. 4,919,199 to Hahn in that it has a V-shaped bend along its length, with an apex 34 of the bend facing inwardly and free arm ends 36 facing outwardly. That is, the apexes 34 of the first and second bent metallic strips 30 and 32 face each other while the free arm ends 36 face away from each other. Formed in the free arm ends 36 are periodically spaced indentation saddles 38 for receiving the tubes 14. The indentation saddles 38 have diameters which are at least as great as the diameters of the tubes they are to receive, but they could have a greater diameters to allow for position tolerances. In the FIG. 3 embodiment, there need not be saddles on the apexes 34, that is at inner sides 40 of the first and second bent metallic strips 30 and 32. The inner sides 40 of the first and second bent metallic strips 30 and 32 are interconnected with each other by coiled compression springs 42, 44 and 46. As can be seen in FIG. 3 the coiled compression springs 42, 44 and 46 are of increasingly longer lengths, with the coiled compression spring 42) being the longest, spring 46 being the shortest, and spring 44 being in the middle.

In operation, a narrower end 48 of the stake 28 is inserted into a lane 20 between adjacent first and second rows 16 and the stake 28 is inserted transversely into the tube bundle 10 along this lane. As the stake 28 is inserted into the lane 20 the coiled compression springs are compressed by tubes in the rows forming the lane 20 via the first and second bent metallic strips 30 and 32. Once the stake 28 is fully inserted into the tube bundle 10, tubes 14 of the rows 16 forming the lane 20 into which the stake 28 is inserted become seated in the indentation saddles 38, and the tubes of the first tube row are pressed away from the tubes of the second tube row, and vice versa, by the compressed coiled compression springs 42–46, again acting through the bent metallic strips 30 and 32. In addition, the bent metallic strips 30 and 32 themselves, since they form leaf springs, provide resiliency for helping to apply pressure on the tubes of the adjacent tube rows.

Figure 5:
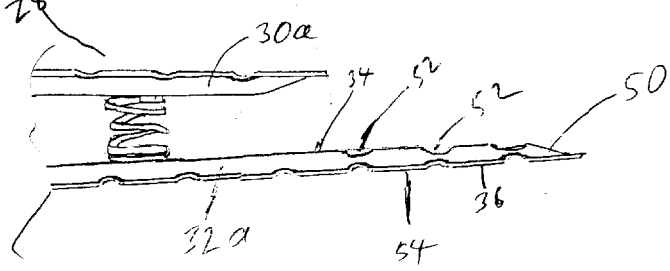
FIG. 5 it is a fragmented view of a tip of a second-embodiment of the stake of this invention.

FIG. 5 depicts another embodiment of a stake 28*a* of this invention in which an outer tip 50 of a second bent metallic strip 32*a* is longer then an outer tip of a first bent metallic strip 30*a*. In this embodiment, the second bent metallic strip 32*a* also has indentation saddles 52 on its inner side, at the apex of its V-shaped bend, at the elongated portion. In operation of this embodiment, the stake 28*a* is inserted transversely into a tube bundle 10 along a lane 20 at spans 26, in the same manner as is the embodiment of FIG. 3. However, in this embodiment, the elongated portion 54 can extend further into the tube bundle, for example into the hexagon 18 shown in FIG. 1 where the tubes are quite densely packed and there is not enough room for both the first and second bent metallic strips 30*a* and 32*a*. Within this hexagon, both the apex 34 and the free arm ends 36 of the second bent metallic strip 32*a* engage tubes on opposite sides of the lane and the second bent metallic strip 32*a* provides the only resiliency applying pressure on these tubes for damping vibrations of the tubes. In this respect, it should be pointed out that the problems of vibrations are most acute at the outer-most tubes, since it is at that point that the steam has the highest velocity. As the steam enters the tube bundle 10, it loses velocity so that when it reaches the inner most tubes, where the tubes are packed the most densely, it is not as likely to cause the tubes to unduly vibrate.

The stake of this invention has the advantage of providing two sources of resiliency, namely, the first and second bent metallic strips, which serve as leaf springs, and the coiled springs. This increased resiliency tends to dampen vibrations to a greater extent then does the stakes of the prior art.

Further, the coiled springs allow the stake to be used in much larger ranges of lane widths between adjacent rows of tubes then did the stakes of the prior art. Thus, one need not manufacture stakes of so many different sizes as was necessary with prior art stakes.

The embodiment of FIG. 5 can be used with a tube bundle having radial rows which surround densely packed heat exchanger tubes.

While the invention has been particularly shown and described with reference to a preferred embodiment, it will be understood by those skilled in the art that various changes in form and detail may be made therein without departing from the spirit and scope of the invention. For example, in some embodiments it is not necessary that the coiled springs be of different lengths, so that the first and second bent metallic strips are substantially parallel. Further, other separate compression springs can be substituted for the coiled springs.

I claim:

1. A stake for being inserted transversely into a lane between first and second adjacent rows of tubes in a tube bundle for damping movement of said tubes in said bundle, said stake comprising first and second elongated metal strips, each of said first and second metal strips having a longitudinal axis, an outer side and an inner side, said first and second elongated metal strips being arranged with their inner sides facing one another, with said stake further including at least one compression spring extending between said inner sides of said metal strips and being attached to said metal strips for resiliently resisting pressure pressing said metal strips together, whereby when said stake is inserted between said first and second rows of tubes in said tube bundle, said first and second metal strips respectively contact tubes of said first and second rows, thereby compressing said springs which, in turn, urge, via said first and second metal strips, said tubes of said first row away from said tubes of said second row; wherein there are a plurality of compression springs having progressively greater lengths so that said metal strips are arranged at angles along their lengths relative to one another.

2. The stake as in claim 1 wherein each of said first and second elongated metal strips has a plurality of indentation saddles therealong for receiving tubes when said stake is fully inserted into said lane of sad tube bundle.

3. The stake as in claim 2 wherein at least one of said first and second metal strips has a V-shaped bend when seen in cross section perpendicular to its length axis so as to form a leaf spring.

4. The stake as in claim 3 wherein said indentation saddles are at free arm ends of the V shape of the at least one of the first and second metal strips, with an apex of the V shape being directed toward the other of the first and second metal strips and the free arm ends being directed away from the other of the first and second metal strips.

5. The stake as in claim 1 wherein at least one of said first and second metal strips has a V-shaped bend when seen in cross section perpendicular to its length axis so as to form a leaf spring.

6. The stake as in claim 1 wherein said second elongated metal strip is longer than said first elongated metal strip.

7. The stake as in claim 6 wherein said second elongated metal strip has a V-shaped bend along its length when seen in cross-section and perpendicular to its length axis so as to form a leaf spring and has indentation saddles on both outer and inner sides of that portion of said second elongated metal strip which extends beyond the first elongated metal strip.

8. The stake as in claim 1 wherein said at least one compression spring is a coiled spring.

9. The stake as in claim 8 wherein there are a plurality of compression coiled springs.

10. A stake for being inserted transversely into a lane between first and second adjacent rows of tubes in a tube bundle for damping movement of said tubes in said bundle, said stake comprising first and second elongated metal strips, each of said first and second metal strips having a longitudinal axis, an outer side and an inner side, said first and second elongated metal strips being arranged with their inner sides facing one another, with said stake further including at least one compression spring extending between said inner sides of said metal strips and being attached to said metal strips for resiliently resisting pressure pressing said metal strips together, whereby when said stake is inserted between said first and second rows of tubes in said tube bundle, said first and second metal strips respectively contact tubes of said first and second rows, thereby compressing said springs which, in turn, urge, via said first and second metal strips, said tubes of said first row away from said tubes of said second row; wherein said at least one compression spring is a coiled spring.

11. The stake as in claim 10 wherein there are a plurality of compression coiled springs.

12. The stake as in claim 10 wherein said second elongated metal strip is longer than said first elongated metal strip.

13. The stake as in claim 10 wherein each of said first and second elongated metal strips has a plurality of indentation saddles therealong for receiving tubes when said stake is fully inserted into said lane of said tube bundle.

14. The stake as in claim 13 wherein at least one of said first and second metal strips has a V-shaped bend when seen in cross section perpendicular to its length axis so as to form a leaf spring.

15. The stake as in claim 14 wherein said indentation saddles are at free arm ends of the V shape of the at least one of the first and second metal strips, with an apex of the V shape being directed toward the other of the first and second metal strips and the free arm ends being directed away from the other of the first and second metal strips.

16. The stake as in claim 10 wherein said second elongated metal strip has a V-shaped bend along its length when seen in cross section and perpendicular to its length axis so as to form a leaf spring and is longer than said first elongated metal strip.

17. The stake as in claim 16 wherein said second elongated metal strip has indentation saddles on both outer and inner sides of that portion of said second elongated metal strip which extends beyond the first elongated metal strip.

* * * * *